United States Patent [19]

Drummond

[11] 4,208,000

[45] Jun. 17, 1980

[54] APPARATUS FOR ADVANCING STRAND MATERIAL

[75] Inventor: Warren W. Drummond, Allison Park, Pa.

[73] Assignee: PPG Industries, Inc., Pittsburgh, Pa.

[21] Appl. No.: 891,565

[22] Filed: Mar. 29, 1978

Related U.S. Application Data

[63] Continuation-in-part of Ser. No. 821,687, Aug. 4, 1977, abandoned.

[51] Int. Cl.[2] ..... B65H 51/02; B65H 51/14; C03B 37/00

[52] U.S. Cl. ..... 226/171; 19/299; 28/107; 65/9; 65/11 R

[58] Field of Search ..... 226/168, 170, 171; 65/2, 3, 11 R, 11 W, 9; 19/299; 28/107; 425/66

[56] References Cited

U.S. PATENT DOCUMENTS

| | | | |
|---|---|---|---|
| 2,685,763 | 8/1954 | Courtney et al. | 226/170 X |
| 2,690,628 | 10/1954 | Courtney et al. | 65/11 W X |
| 3,293,013 | 12/1966 | Drummond | 65/9 |
| 3,676,096 | 7/1972 | Schuller et al. | 65/3 |
| 3,746,230 | 7/1973 | Gelin | 65/9 X |
| 3,887,347 | 6/1975 | Reese | 65/2 X |
| 3,915,681 | 10/1975 | Ackley | 65/11 R X |
| 3,955,952 | 5/1976 | Drummond | 65/11 W |
| 3,997,308 | 12/1976 | Drummond et al. | 65/2 X |
| 3,999,971 | 12/1976 | Drummond | 65/9 |
| 4,013,433 | 3/1977 | Briar | 65/11 W X |
| 4,033,741 | 7/1977 | Drummond | 65/11 W X |

*Primary Examiner*—Stanley N. Gilreath
*Attorney, Agent, or Firm*—John E. Curley; Alan T. McDonald

[57] ABSTRACT

An apparatus is disclosed for the attenuation or advancing of strand material, such as glass strands. The apparatus includes a single belt and a plurality of wheels around which the belt is driven and guided. The strand is attenuated as it passes between the belt and one of the wheels. The wheel which, along with the belt, attenuates or advances the strand may have a plurality of pins or bars to form its exterior surface, which surface is then discontinuous. Alternatively, this wheel surface may be continuous. The driving force for the belt comes from another of the wheels, with the driving force being applied to the belt on the opposing surface of the belt from that which contacts the strand.

7 Claims, 6 Drawing Figures

FIG. 1
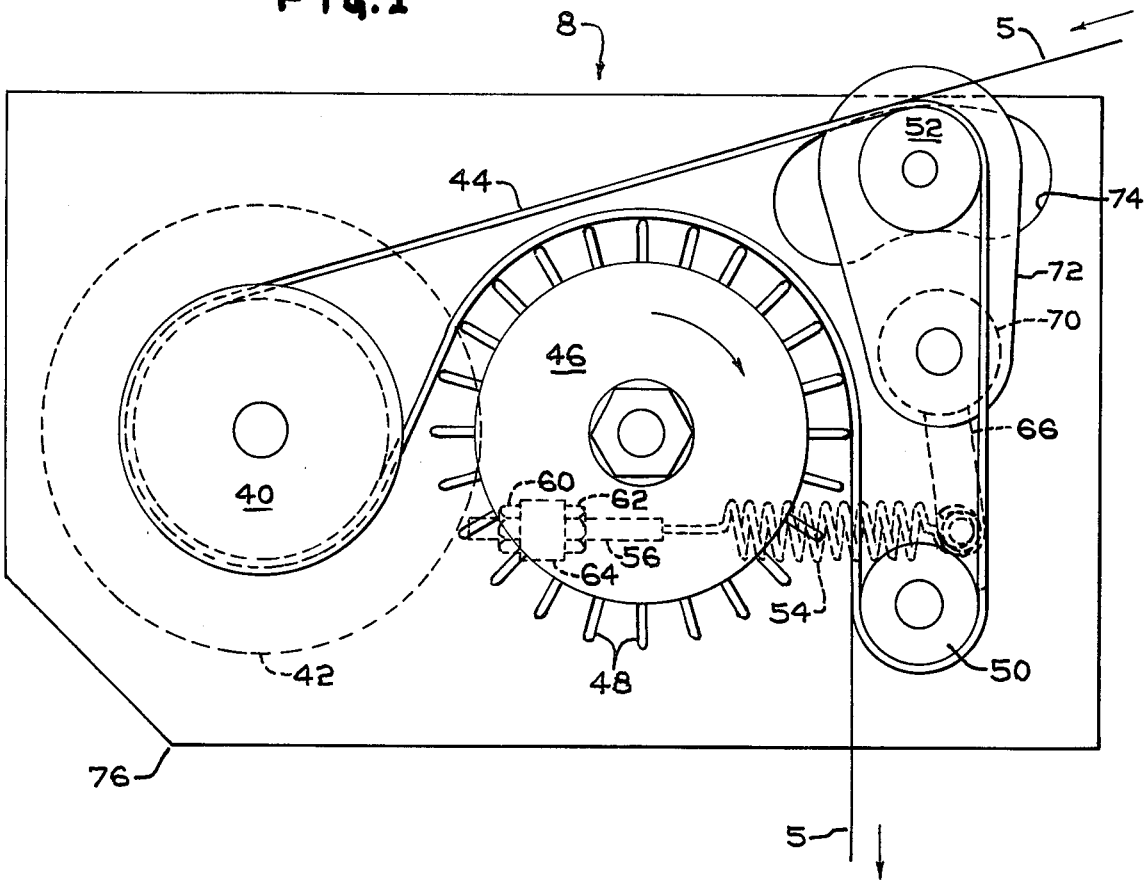
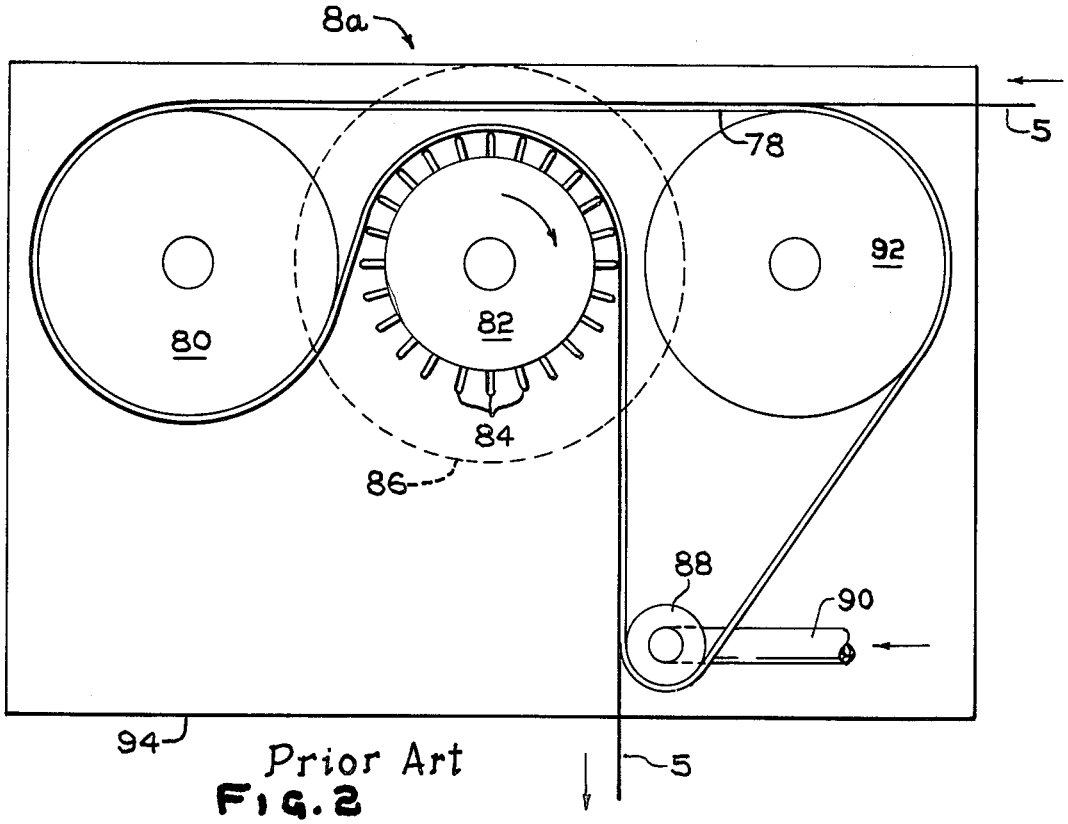
Prior Art
FIG. 2

APPARATUS FOR ADVANCING STRAND MATERIAL

CROSS-REFERENCE TO RELATED APPLICATIONS

This is a continuation-in-part of U.S. Application Ser. No. 821,687, filed Aug. 4, 1977, now abandoned.

BACKGROUND OF THE INVENTION

Glass filaments are typically attenuated from bushing tips located at the bottom of a heated bushing containing molten glass. The filaments as they are attenuated are passed across the application surface of an applicator where a binder and/or size is applied to the filaments. Then, the filaments are passed into a gathering means, such a a gathering shoe, which is typically a grooved wheel or cylinder formed of a material such as graphite, with the filaments being gathered into one or more unified strands in the grooves of the gathering shoe. The thus formed strands are then passed to an attenuator, which attenuator provides the forces necessary to pull or attenuate the filaments from the bushing. As used herein, the term attenuator refers to an apparatus which may attenuate the filaments and advance the strand or to an apparatus for advancing a previously formed strand in its movement. This attenuator may be the rotating surface of a winder, a belt attenuator, a wheel attenuator or the like. Other strand materials, such as nylon, polyester and the like are similarly attenuated through orifices.

When strands, such as glass strands, nylon strands, polyester strands and the like, are collected to be packaged in bulk containers or laid down as a continuous strand mat, they often are not collected on a rotating surface, but are attenuated by means of a belt or wheel attenuator onto the mat surface. It is also possible to form strand mats by directing previously formed strand from forming packages onto the mat formation surface with an attenuator. In this case, the attenuator, or strand advancing apparatus, does not actually attenuate the filaments. Rather, in this case the attenuator merely acts to remove strand from the forming package and direct it onto the mat formation surface.

Wheel attenuators, such as those shown in U.S. Pat. No. 3,676,096 and U.S. Pat. No. 3,746,230, are often unsatisfactory. These attenuators, which employ only the cohesive forces of the wet strand against the wheel surface to attenuate the filaments, often supply insufficient tractive forces for attenuating the filaments, do to slippage. In addition, these attenuators are prone to strand wraps, wherein the strand does not exit the wheel at the desired point but rather loops around the wheel and begins to form a package of strand on the wheel, as is routinely done in the formation of forming packages on a rotating collet. Such slippage and strand wraps interfere with the production of the strand and/or the mat.

To overcome the inefficiencies of the wheel attenuators, belt attenuators have been produced. Typical of the belt attenuators which are known are those shown in U.S. Pat. Nos. 2,690,628; 3,293,013; 3,887,347; 3,955,952; 3,997,308; and 3,999,971.

In these attenuators, the strand material passes between a pair of belt surfaces, which surfaces are maintained tightly against one another. Attenuation thus results by the action of the two belts against the strand as the belts and strand progress along their paths. While these attenuators have improved the problems of slippage and strand wraps, they have created new problems of their own. In order for these attenuators to function properly, the belts must maintain tight contact with one another and with the strand material. If this tight contact is not maintained, slippage will again result. This tight contact and continuous motion results in abrasion of the belts and requires frequent replacement of the belts, adding to the cost of producing the product both in downtime and equipment costs.

In order to overcome the problems of the wheel attenuators and the problems of the belt attenuators, hybrid belt-wheel attenuators have been developed. These attenuators employ a single belt which is driven around a plurality of wheels. The strand is attenuated between the belt and one of the wheels. This wheel may have discontinuous surface, to both reduce contact of the strand with the wheel and thus abrasion of the wheel and the belt and to prevent strand wraps. This wheel also provides the driving force for the belt.

Problems have arisen with such hybrid attenuators. First, since the driving force for the belt is accomplished on the same surface of the belt as the tractive forces on the strand, and since this belt must be maintained extremely tight on the wheels to provide for this driving and attenuative action, the belt surface quickly deteriorates. Second, even with the taut surfaces of the belt, slippage of the strand material between the belt and the attenuation wheel has been a problem.

It is thus desirable to produce an attenuator or strand advancing apparatus which overcomes the slippage and strand wrap problems of wheel attenuators and the wear problem of belt attenuators.

THE PRESENT INVENTION

By means of the present invention, a hybrid belt-wheel attenuator is provided which substantially reduces both the wear problem of belt attenuators and the slippage and strand wrap problems of wheel attenuators. The attenuator of the present invention includes a single belt and a wheel, with the strand being attenuated between this wheel and the belt. This wheel may have a continuous or a discontinuous surface. However, contrary to the practice in the past, this wheel does not provide the driving force for the belt, but rather is free-wheeling and is rotated by the belt. The driving force for the belt and the wheel is provided by another of the wheels around which the belt passes. This driving force is placed on the belt on the opposite surface of the belt from the surface on which the strand rides. Thus, since the belt is not driven at the points where it contacts both the wheel and the strand, and since the belt is not driven on its surface in contact with the strand; reduced wear of the belt surface in contact with the strand is realized. Further, since the wheel contacting the belt and the strand does not provide the driving force for the belt, the belt does not need as tight a contact with this wheel as was previously necessary, further reducing wear of the belt. Thus, an additional advantage of the attenuator of the present invention is the ability to use a "loose" belt, which has not previously been possible with either belt attenuators or hybrid belt-wheel attenuators. Further advantages of the attenuator of the present invention will become clear to those skilled in the art during the detailed description of the invention.

BRIEF DESCRIPTION OF THE DRAWINGS

The attenuator of the present invention will be more fully described with reference to the drawings in which:

FIG. 1 is a front elevational view of a belt-wheel attenuator according to a first embodiment of the present invention;

FIG. 2 is a front elevational view of a single belt-wheel attenuator of the prior art;

DETAILED DESCRIPTION OF THE DRAWINGS

Figure 3:
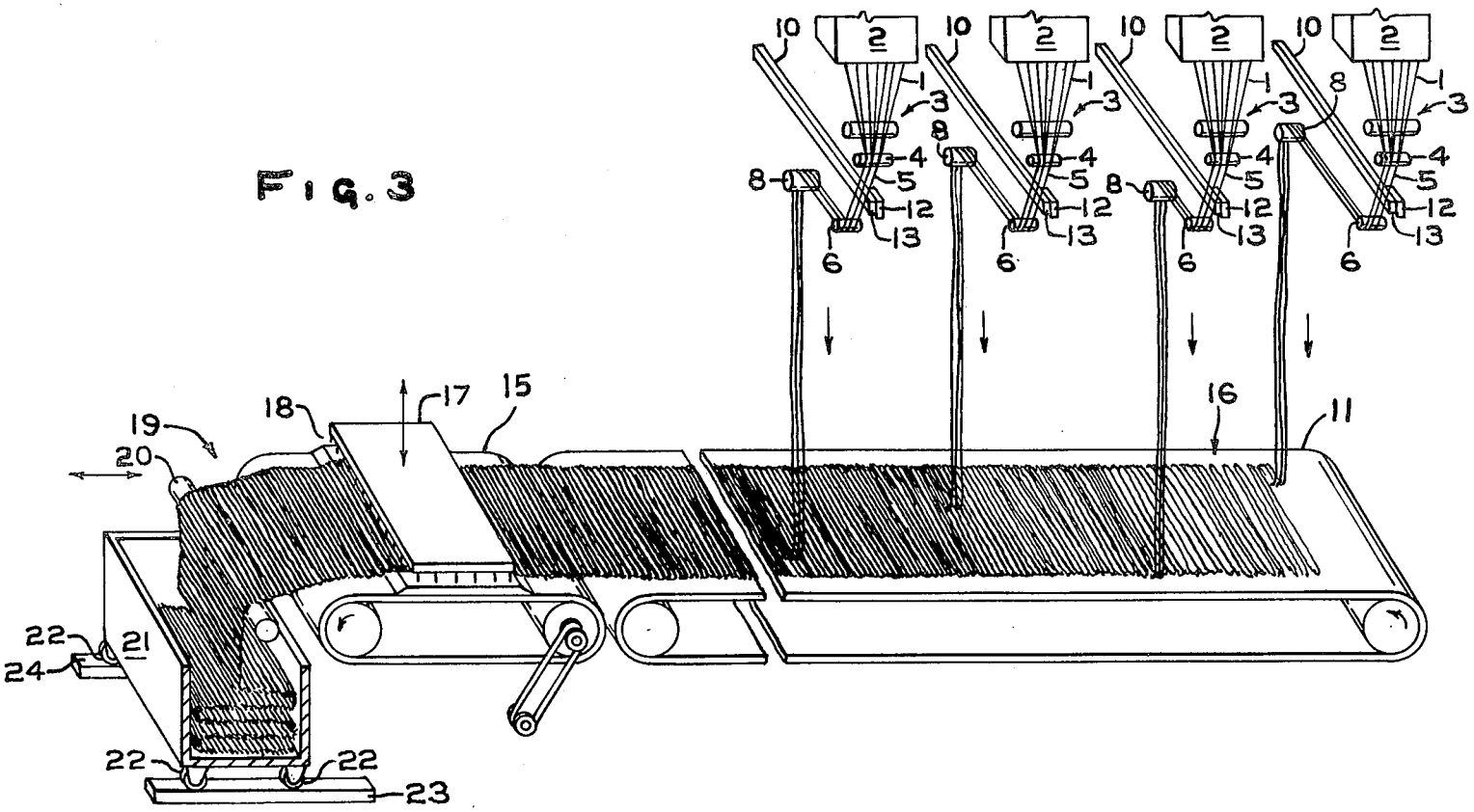
FIGS. 3 and 4 illustrate the operation of the attenuator of FIG. 1 in a glass mat forming operation.

The invention will be partially further illustrated with respect to the attenuation of glass strands. It is clear, however, that the attenuator of the present invention may be employed with any strand material, such as nylon, polyester or any other natural or synthetic fiber.

Turning to FIG. 1, the attenuator 8 according to a first embodiment of the present invention is illustrated. Strands 5 coming from a fiber forming bushing or strands from forming packages of previously formed strands pass along the outside of a belt 44. The width of the belt 44 may vary, typically from about 0.5 to 6.0 inches (1.27 to 15.24 centimeters), more or less, depending upon whether a single or a number of strands are to be attenuated or advanced and upon the width of the plurality of strands being attenuated or advanced. The belt 44 and strands 5 pass around a rotating wheel 40. This wheel is driven by a driving means. Typically, this driving means is a motor 42, such as a variable speed electric motor or a variable speed air motor. Thus, as the strands 5 pass around the wheel 40 on the outside surface of the belt 44, the belt 44 is driven by the motor 42 and the wheel 40 on its inside surface. The contact between the strands 5 and the belt 44 as they pass around wheel 40 produces some of the tractive forces necessary to attenuate or advance the strands 5.

The belt 44 and strands 5 progress from wheel 40 to wheel 46. The wheel 46 is free-wheeling about a bearing (not shown), such as a ball bearing. In this embodiment, the wheel 46 includes a plurality of pins or bars 48, such as flight bars, protruding from the surface thereof. The strands 5 contact these pins with the strands 5 being held between the pins 48 and the belt 44, which points of contact produce the additional tractive forces necessary to attenuate the strands 5 from the bushing or advance the strands 5 from a forming package. Since the strands 5 contact the wheel 46 only at the pins 48, rather than along an entire continuous surface, they do not tend to adhere to the pins 48 with the same tenacity as they adhere to a continuous surface, which prevents strand wraps about the wheel 46. However, their adherence to the pins 48 is sufficient, in combination with the tractive forces of the belt 44 upon the strands 5 around wheel 40, to attenuate or advance the strands 5, such that the belt 44 need not be completely taut.

Since the strands 5 are carried between the outside surface of the belt 44 and the pins 48 while the belt 44 is driven by motor 42 and wheel 40 from the inside surface, the useful life of both belt surfaces is greatly increased due to decreased frictional forces between the belt 44 and the strands 5 at the pins 48. Further, since the belt 44 is not driven at its point contact 48 with the wheel 46, the belt 44 need not be as taut as has previously been required, again leading to increased belt life.

The strands 5 leave the surface of the belt 44 and are projected into space as the belt 44 leaves the pins 48 and passes around free-wheeling roller 50. The strands pass to a collection means, such as a container or mat forming line. The roller 50 is free-wheeling about a bearing (not shown), such as a ball bearing. Finally, to complete the cycle, the belt passes around free-wheeling roller 52 which is also mounted on a bearing (not shown), such as a ball bearing, where the belt 44 picks up strands 5 to again begin the cycle.

As was previously mentioned, the belt 44 need not be completely taut. The tension on the belt 44 is regulated at roller 52. Wheels 40 and 46 and roller 50 are fixed in position. However, roller 52 is mounted on arm 72 and may pivot with arm 72 about pin 70 which is mounted on base 76 of the attenuator 8. Pin 70 is in turn mounted on arm 66. At the other end of arm 66 is located a spring 54, whose tension is adjusted by means of threaded connector 56 connected thereto, nuts 60 and 62 and spacer 64, with spacer 64 being connected to base 76.

Thus, to adjust the tension of belt 44, threaded connector 56 is adjusted in its position with respect to spacer 64 by means of nuts 60 and 62. Of course, a single nut could be employed. However, the pair of nuts 60 and 62 lock the connector 56 in place with less chance of movement. Connector 56 exerts a force on spring 54 which in turn then exerts a force on arm 66 which, through pin 70 exerts a force to pivot arm 72 and positions roller 52, thus tensioning belt 44.

Figure 5:
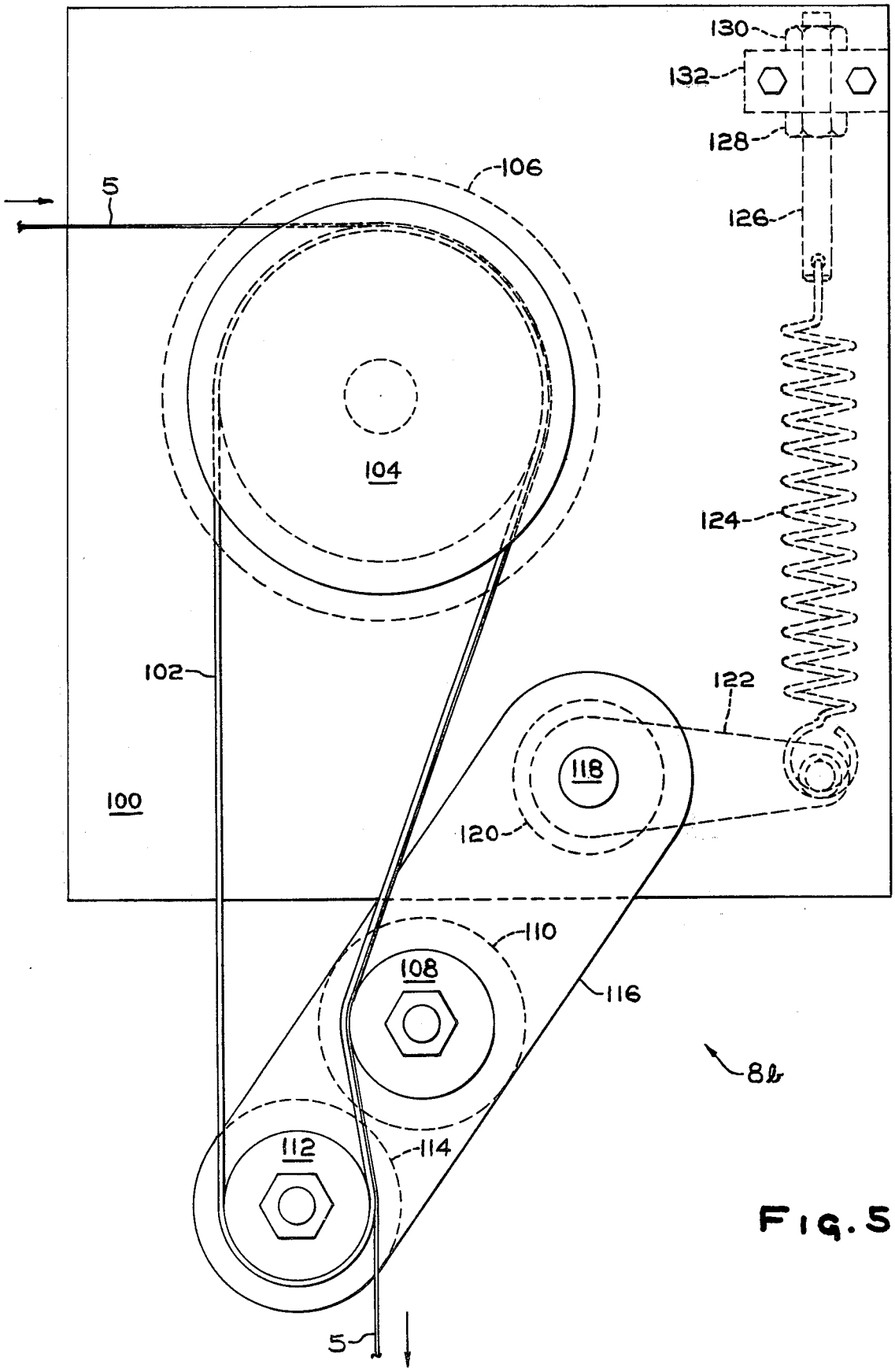
FIG. 5 is a front elevational view of a belt-wheel attenuator according to a second embodiment of the present invention.

An attenuator 8b according to a second embodiment of the present invention is illustrated in FIG. 5. Strands 5 coming from a fiber forming bushing or from a previously produced forming package pass along the outside surface of a belt 102. Similar to the attenuator 8 of FIG. 1, the width of the belt 102 may vary, typically from about 0.5 to 6.0 inches (1.27 to 15.24 centimeters), more or less, depending upon whether a single or a number of strands are to be attenuated or advanced and upon the width of the plurality of strands being attenuated or advanced. The belt 102 and strands 5 pass around a rotating wheel 104. This wheel is driven by a driving means. Typically, this driving means is a motor 106, such as a variable speed electric motor or a variable speed air motor. Thus, as the strands 5 pass around the wheel 104 on the outside surface of the belt 102, the belt 102 is driven by the motor 106 and the wheel 104 on its inside surface. The contact between the strands 5 and the belt 102 as they pass around wheel 104 produces some of the tractive forces necessary to attenuate or advance the strands 5.

The belt 102 and the strands 5 progress from wheel 104 to wheel 108. The wheel 108 is free-wheeling about a bearing 110, such as a ball bearing. In this embodiment, the wheel 108 has a continuous surface which may be smooth or roughened. The contact of the belt 102 and the strands 5 with the surface of wheel 108 is over only a small portion of the entire circumference of wheel 108, to prevent strand wraps, but the tractive forces on the strands 5 between belt 102 and wheel 108 is sufficient, in combination with the tractive forces of the belt 102 upon the strands 5 around wheel 104, to attenuate or advance the strands 5, such that the belt 102 need not be completely taut.

Since the strands 5 are carried between the outside surface of the belt 102 and the wheel 108 while the belt 102 is driven by motor 106 from the inside surface, similar to the attenuator 8 of FIG. 1, the useful life of both belt surfaces is greatly increased due to decreased frictional forces between the belt 102 and the strands 5 around wheel 108. Further, since the belt 102 is not driven at its contact with wheel 108, the belt 102 need not be as taut as has previously been required, again leading to increased belt life.

The strands 5 leave the surface of the belt 102 and are projected into space as the belt 102 leaves the wheel 108 and passes around free-wheeling roller 112. The strands 5 pass to a collection means, such as a container or mat forming line. The roller 112 is free-wheeling about a bearing 114, such as a ball bearing. Finally, to complete the cycle, the belt passes back to wheel 104 where the belt 102 picks up strands 5 to again begin the cycle.

As was previously mentioned, the belt 102 need not be completely taut. The tension on the belt 102 is regulated at wheel 108 and roller 112. Wheel 104 is fixed in position. However, wheel 108 and roller 112 are mounted on arm 116 and may pivot with arm 116 about pin 118 which is mounted on bearing 120, which is in turn mounted on base 100 of the attenuator **8*b*. Pin 118 is in turn mounted on arm 122. At the other end of arm 122 is located a spring 124, whose tension is adjusted by means of threaded connector 126 connected thereto, nuts 128 and 130 and spacer 132, with spacer 132 being connected to base 100**.

Thus, to adjust the tension of belt 102, threaded connector 126 is adjusted in its position with respect to spacer 132 by means of nuts 128 and 130. Of course, a single nut could be employed. However, the pair of nuts 128 and 130 lock the connector 126 in place with less chance of movement.

Connector 126 exerts a force on spring 124 which in turn exerts a force on arm 122 which, through pin 118, exerts a force to pivot arm 116 and positions wheel 108 and roller 112, thus tensioning belt 102.

FIG. 2 illustrates a belt-wheel attenuator **8*a* of the prior art, for comparison purposes. In this attenuator 8*a* the strands 5 pass along belt 78 and around the outside of wheel 80. Wheel 80 is free-wheeling about a bearing (not shown). The strands 5 and belt 78 then pass around wheel 82, contacting only pins 84 protruding therefrom. Wheel 82 is driven by motor 86. The force exerted on the strands between the pins 84 and the belt 78 again provides the attenuative forces to produce the strands 5 from a bushing or remove the strands 5 from a forming package. However, in addition to this, the force on the belt 78 from its contact with the pins 84 is the driving force for the belt 78. Since the entire driving force for the belt 78 is provided by the point contacts between the belt 78 and the pins 84, this belt must be kept extremely taut at all times. If this tautness is not maintained at all times in the belt 78, slippage will result, thus affecting the attenuation of the strands 5** and producing inconsistant filament diameters and/or inconsistant mat formation.

Due to the required tautness of the belt 78 and both the driving of the belt 78 and attenuation of the strands 5 by the pins 84 on its outside surface, a great degree of wear quickly develops on the outside surface of the belt 78 which contact the strands 5. This wear is far in excess of that seen by the belt 44 on attenuators 8 and **8*b* shown in FIGS. 1 and 5 where the belt is driven from its inside surface while the strands are attenuated between the wheel and the outside surface of the belt 44. Thus, while the belt 78 employed in attenuator 8*a* typically has a useful life of about 24 hours, the belts employed in attenuators 8 and 8*b*** of the present invention may have a useful life of 120 hours or more. Since the replacement of a belt requires shutdown of the bushing position or strand advancing position which is being attenuated or advanced, great efficiency and cost savings result from increased belt life.

Returning to FIG. 2, the belt 78 and strands 5 leave the pins 84 and head downwardly. The strands 5 leave the belt 78 and are projected downwardly as the belt 78 passes around roller 88.

Again due to the tautness of the belt 78, roller 88 cannot be mounted on a ball bearing as rollers 50 or 112 can be mounted. Due to the combination of the speed of the belt 78, and thus the rotational speed of the roller 88, and the tautness of the belt 78, this roller 88 must be mounted on an air bearing having an air inlet 90. In addition, to maintain the tension of the belt 78, roller 88 is mounted on an air cylinder (not shown) mounted on base 94. The air cylinder provides a constant downward force on roller 88 to maintain the tension on the belt 78. The combination of the air cylinder and the air bearing requires two air supplies to be provided for the attenuator **8*a***. The attenuator of the present invention requires no compressed air to operate, unless an air motor is selected to operate the attenuator. In any event, no air supply is necessary to maintain tautness in the belts, which results in cost savings in compressed air and the mechanisms necessary to provide it.

To complete its cycle, the belt 78 after leaving roller 88, passes around free-wheeling roller 92 where it again picks up strands 5 and begins a new cycle.

Figure 4:
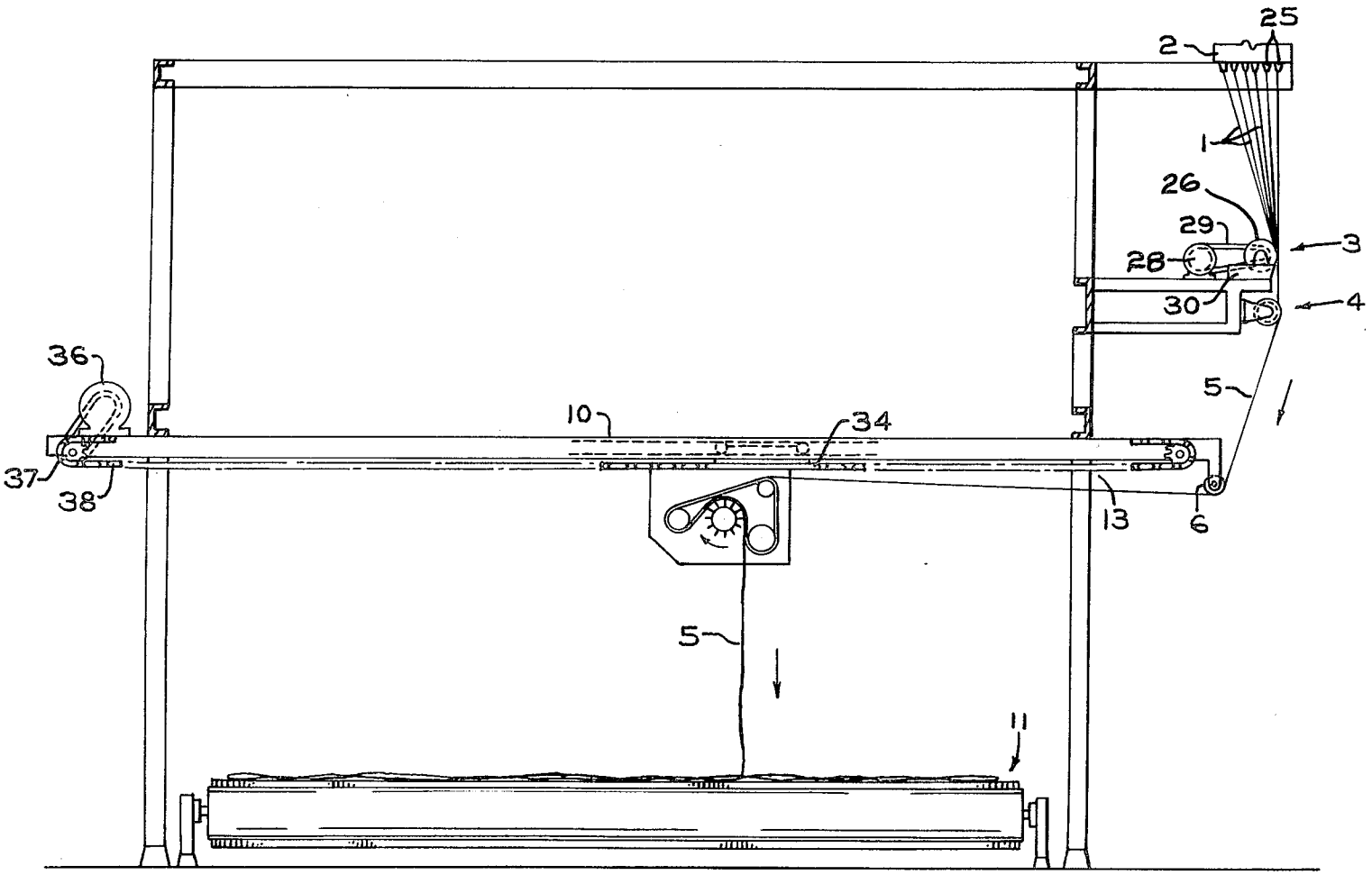

FIGS. 3 and 4 illustrate the operation of the attenuators 8 or **8*b*** of the present invention in a continuing glass forming and mat making operation.

Referring now to FIG. 3, glass fibers forming single filaments 1 are drawn from a bushing 2, passed over an applicator 3, such as a roller applicator, which applies a suitable size to the filaments 1. The size lubricates the filaments to prevent them from breakage and additionally provides a binder which holds the filaments 1 into strands 5 which are to be subsequently formed. Further, the sizing composition provides adhesion between the glass filaments 1 and a resin matrix when the fibers are to be used for resin reinforcement. The sizing composition is usually an aqueous solution of a particular binder in a glass fiber lubricant.

After the filaments 1 are sized, they are passed over a gathering shoe 4. This gathering shoe is a cylinder having a plurality of grooves through which the filaments 1 are drawn together thus forming strands 5. The gathering shoe is formed from a material which has sufficient lubricative properties such that the filaments may be gathered without breakage. A typical material of construction for the gathering shoe is graphite, however, other materials may be used provided they supply the proper lubricity to prevent breakage of the strands 5 and filaments 1. The strands 5 are passed over an idler roller 6 which directs the strands 5 toward the attenuator 8. While the attenuator 8 of FIG. 1 is illustrated, the attenuator **8*b* of FIG. 5 may be also employed. The strands 5 are then attenuated by the attenuator 8 as previously described. The attenuator 8 is mounted on a track 10 which can be made of a channel properly constructed to allow the attenuator 8 to traverse in a horizontal place to the long axis of conveyor 11, depositing the strands 5 on the surface of the conveyor 11. As the strands 5 from a plurality of forming positions are deposited on the conveyor 11, they form mat 16**.

The mat 16 passes from conveyor 11 to a second conveyor 15 which has a needler 17 thereover. A plurality of needles 18 are pushed through the mat and then pulled out to entwine the strands and provide strength to the mat 16, thus producing a needled mat 19. The needled mat 19 is passed over a supporting guide roll 20 and into a collector 21. The collector 21 reciprocates in a plane with the movement of the conveyor 15 to fold the needled mat 19 in the collector 21 on wheels 22 mounted on tracks 23 and 24.

Referring to FIG. 4, the filaments 1 are drawn from the bushing 2, having a plurality of orifices or bushing tips 25, and passed over this applicator 3 which is driven by motor 28. The motor 28 rotates cylinder 26 by means of a belt 29 so that the roller 26 which is partially immersed in pan 30 containing the sizing material turns in the pan 30. After sizing, the filaments 1 are gathered by gathering shoe 4, and drawn into a plurality of strands 5. The strands are passed over an idler 6 and attenuated by means of the attenuator 8 as previously described. The attenuator 8 is traversed by means of a reversing motor 36, which drives pulley 37, driving chain 38 which traversed the support 34 for the attenuator 8 across the width of the conveyor 11 any desired distance.

Figure 6:
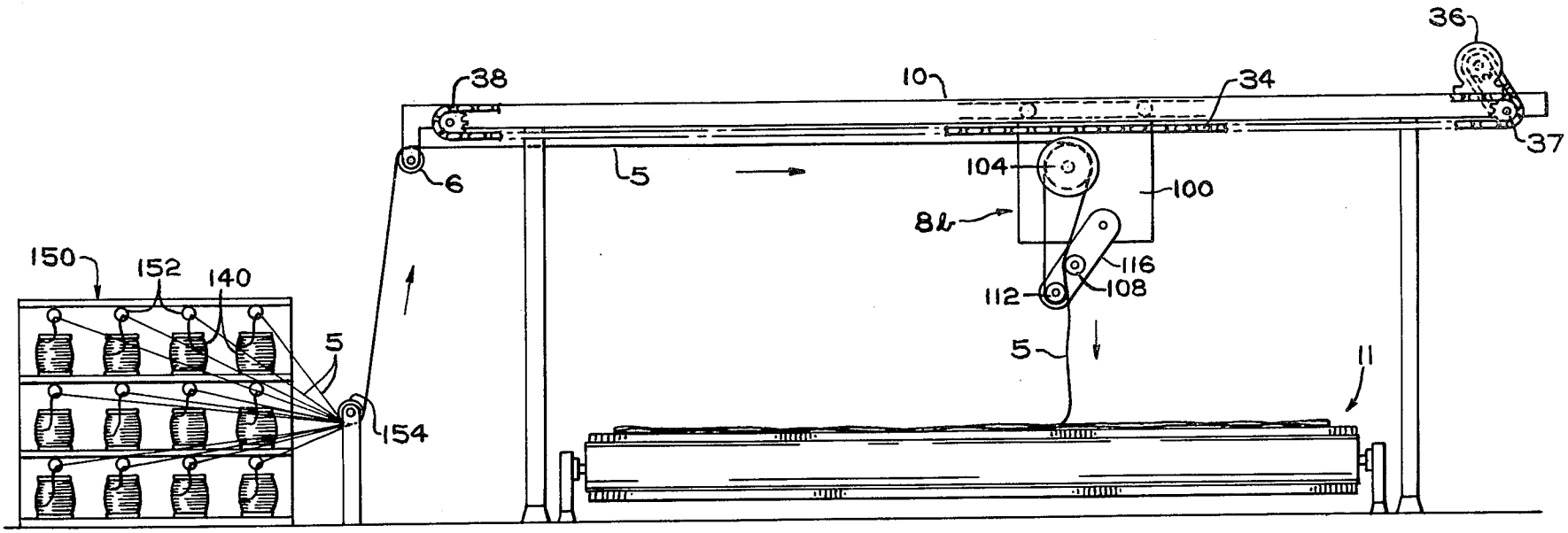
FIG. 6 illustrates the operation of the attenuator of FIG. 5 in a mat formation operation using forming packages as the strand supply source.

Alternatively the mat 16 may be laid from previously produced forming packages of strand. Such an operation is illustrated in FIG. 6.

In this FIGURE, a creel 150 containing forming packages 140 of strands 5 are illustrated. The strands 5 may be glass, polyester, nylon or any other natural or synthetic fiber. The strands 5 pass through guides 152 as they leave the forming packages 140. The strands 5 then pass through guide bar 154. Here, the strands 5 may be combined into one or more larger strands. Preferably, however, the strands 5 remain as separate strands and pass to idler roller 6 in a generally parallel path. Between guide bar 154 and roller 6 the strands may be wet with water or another material to reduce the possibility of static build-up. However, this is not necessary. At this point, the strands 5 are advanced by attenuator 8 or **8*b*** in the same manner as previously mentioned.

As can be seen from the foregoing, the present invention provides an improved belt-wheel attenuator or strand advancing apparatus which increases usable belt life and thus reduces costs, reduces the chances of slippage and thus increases the consistancy of strand produced and eliminates the necessity of compressed air supply.

While the invention has been described with respect to certain specific embodiments thereof, it is not intended to be so limited thereby, except as set forth in the accompanying claims.

I claim:

1. An attenuator for advancing strand material from a supply of strand to a fabrication or collection zone comprising an endless belt entrained around spaced rollers in a loose condition, means to positively rotate one of said rollers to provide the driving force for said endless belt on the inside surface of said belt, a wheel mounted for free rotation and engaging the outside surface of the endless belt in a position between said rollers whereby said endless belt makes a partial wrap about said wheel for attenuating and/or advancing strand located between the wheel and the outside surface of the endless belt.

2. The attenuator of claim 1 wherein the means for driving the first wheel is a motor.

3. The attenuator of claim 2 wherein said motor is an electric motor.

4. The attenuator of claim 1 wherein said discontinuous surface of said second wheel comprises a plurality of pins.

5. The attenuator of claim 4 wherein said pins are flight bars.

6. The attenuator or claim 1 including means for adjusting tension on the belt comprising a roller, a first arm connected to said roller, a second arm, a pin around which said first and second arms are pivoted, a spring connected to said second arm and means for adjusting tension on said spring.

7. The attenuator of claim 6 wherein said means for adjusting tension on said spring comprises a threaded connector connected to said spring, a spacer and at least one nut to position said connector and tension said spring.

* * * * *